US011162692B2

(12) United States Patent
Salunkhe et al.

(10) Patent No.: US 11,162,692 B2
(45) Date of Patent: Nov. 2, 2021

(54) FAN ASSEMBLY FOR AN HVAC UNIT

(71) Applicant: Johnson Controls Technology Company, Auburn Hills, MI (US)

(72) Inventors: Ravindra B. Salunkhe, Satara (IN); Swapnil V. Mohite, Pune (IN); Ritesh D. Rokade, Pune (IN); Shridhar V. Vernekar, Sirsi (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 143 days.

(21) Appl. No.: 16/298,886

(22) Filed: Mar. 11, 2019

(65) Prior Publication Data

US 2020/0271332 A1 Aug. 27, 2020

Related U.S. Application Data

(60) Provisional application No. 62/810,830, filed on Feb. 26, 2019.

(51) Int. Cl.
*F24F 1/56* (2011.01)
*F24F 1/38* (2011.01)
(Continued)

(52) U.S. Cl.
CPC ..... *F24F 1/028* (2019.02); *F24F 1/38* (2013.01); *F24F 1/56* (2013.01); *F24F 2013/205* (2013.01)

(58) Field of Classification Search
CPC ..... F24F 1/38; F24F 1/56; F24F 1/028; F24F 1/03; F24F 2013/205; F24F 2013/32;
(Continued)

(56) References Cited

U.S. PATENT DOCUMENTS 2,889,095 A * 6/1959 Reinhold Heidecke ..... A45C 11/38 224/257
3,115,757 A * 12/1963 Day ..... F25B 39/04 62/507
(Continued)

FOREIGN PATENT DOCUMENTS

AU 2008200681 B2 1/2013
CA 2578329 A1 8/2008
(Continued)

OTHER PUBLICATIONS

Screen Captures from YouTube clip entitled "How to Replace a Refrigerator Condenser Fan Motor", 1 page uploaded on Jun. 26, 2015 by user Sears PartsDirect. Retrieved from Internet <https://www.youtube.com/watch?time_continue=44&v=5CDDZA3mX_w&feature=emb_logo> (Year: 2016).*
(Continued)

*Primary Examiner* — Cassey D Bauer
(74) *Attorney, Agent, or Firm* — Fletcher Yoder, P.C.

(57) ABSTRACT

The present disclosure relates to a heating, ventilation, and/or air conditioning (HVAC) unit that includes a condenser fan assembly. The condenser fan assembly includes a support frame having an opening and a condenser fan that is coupled to the support frame and configured to force air through the opening. The condenser fan assembly is configured to translate between an operating position and a service position. The HVAC unit also includes a brace that is configured to extend from an enclosure of the HVAC unit to the condenser fan assembly to hold the condenser fan assembly in the service position.

25 Claims, 11 Drawing Sheets

(51) Int. Cl.
*F24F 13/20* (2006.01)
*F24F 1/028* (2019.01)

(58) Field of Classification Search
CPC . F24F 13/32; F24F 7/02–025; F25D 2221/32; F25D 23/003; E05D 11/1028; E05D 11/1042; E05D 2015/1031; E05C 3/12; E05C 17/12; E05C 17/04; E05C 17/047; E05F 11/08; B65D 43/24; A47B 3/091; A47B 3/087; B60K 11/00–085; F01P 11/00–20
See application file for complete search history.

(56) References Cited

U.S. PATENT DOCUMENTS 4,586,579 A * 5/1986 Matsui ..... E05C 17/14 180/69.21
6,105,376 A 8/2000 Stewart et al.
6,289,555 B1 9/2001 Nguyen et al.
6,585,484 B2 7/2003 Rosenthal et al.
6,716,099 B2 4/2004 Pfleiderer et al.
7,232,370 B1 6/2007 Newell
9,212,668 B2 12/2015 Deng et al.
9,551,499 B1 1/2017 Chwala
9,869,488 B2 1/2018 Glenn et al.
2008/0041569 A1 2/2008 Kennon
2008/0188175 A1 8/2008 Wilkins
2014/0147313 A1 5/2014 Deng et al.
2017/0069923 A1 3/2017 Trevisan et al.
2018/0209672 A1 7/2018 Chwala
2018/0238089 A1* 8/2018 Duvall ..... E05C 17/12
2019/0321757 A1* 10/2019 Jakpor ..... B01D 46/429

FOREIGN PATENT DOCUMENTS

CN 207230768 * 4/2013 ..... F24F 1/06
CN 202965935 U 6/2013
EP 2829737 B1 7/2017
JP 2008076037 A 4/2008

OTHER PUBLICATIONS

English translation of CN 207230768 (Year: 2018).*

* cited by examiner

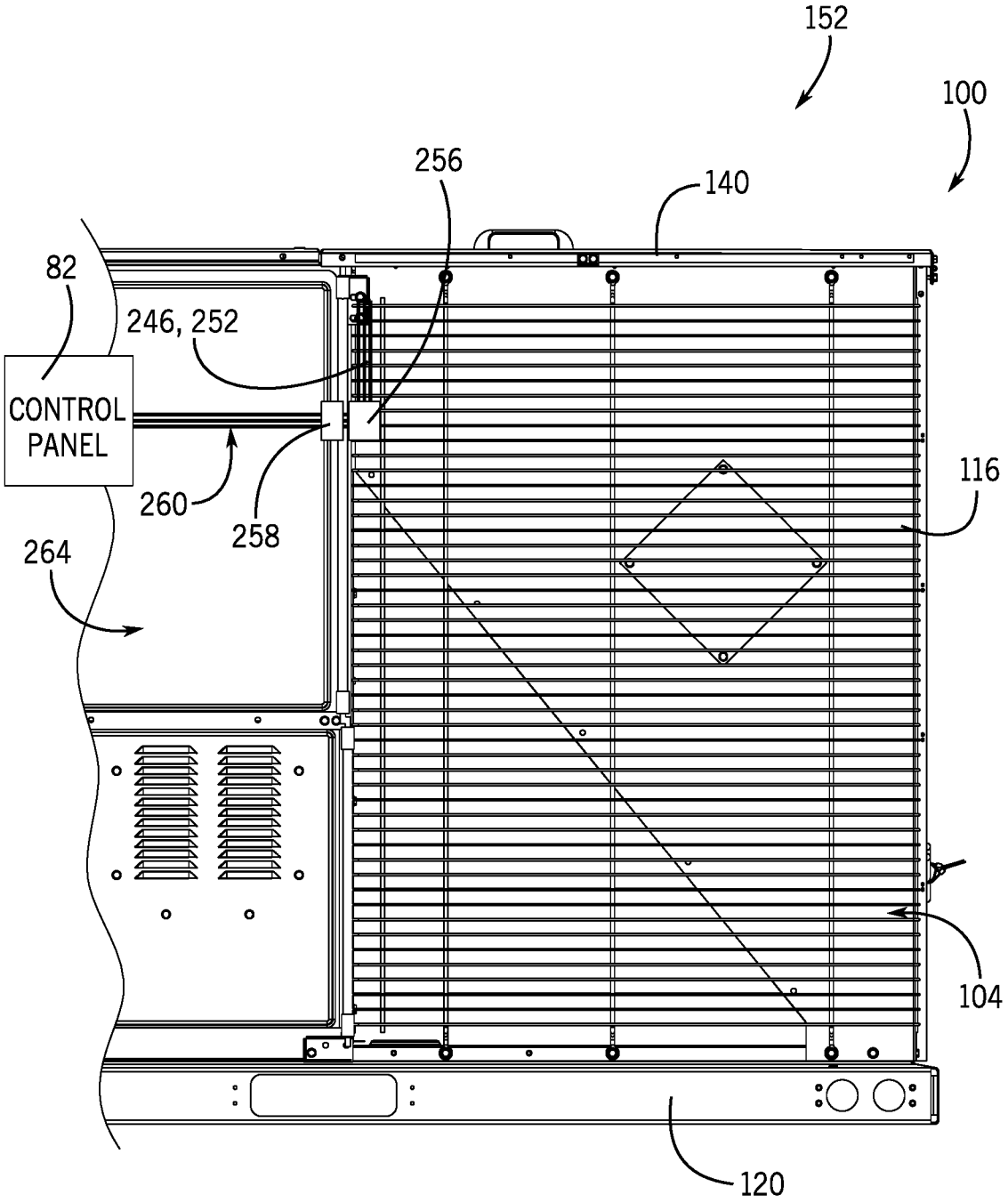
FIG. 14
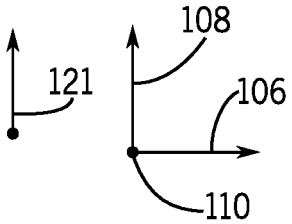

FAN ASSEMBLY FOR AN HVAC UNIT

CROSS-REFERENCE TO RELATED APPLICATIONS

This application claims priority from and the benefit of U.S. Provisional Application Ser. No. 62/810,830, entitled "FAN ASSEMBLY FOR AN HVAC UNIT," filed Feb. 26, 2019, which is herein incorporated by reference in its entirety for all purposes.

BACKGROUND

This disclosure relates generally to heating, ventilation, and/or air conditioning (HVAC) systems. Specifically, the present disclosure relates to a fan assembly for an HVAC unit.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and/or air conditioning (HVAC) unit may be used to thermally regulate an environment, such as a building, home, or other structure. The HVAC unit generally includes a vapor compression system having heat exchangers, such as a condenser and an evaporator, which cooperate to transfer thermal energy between the HVAC unit and the environment. Particularly, a compressor may be used to circulate a refrigerant through the vapor compression system and enable the transfer of thermal energy between the condenser and the evaporator. In many cases, a condenser fan assembly is coupled to the condenser and is configured to enhance a heat transfer rate between refrigerant circulating through the condenser and an ambient environment, such as the atmosphere. For example, the condenser fan assembly may include a plurality of condenser fans that are configured to draw or force an air flow across the condenser. Accordingly, the air traversing the condenser may absorb thermal energy from the refrigerant flowing therein before the refrigerant is recirculated to, for example, the evaporator of the vapor compression system. Unfortunately, condenser fans of conventional HVAC units are often difficult to access, and significant disassembly of the HVAC units may be involved to enable maintenance, inspection, and/or other operations on the condenser fans.

SUMMARY

The present disclosure relates to a heating, ventilation, and/or air conditioning (HVAC) unit that includes a condenser fan assembly. The condenser fan assembly includes a support frame having an opening and includes a condenser fan coupled to the support frame and configured to force air through the opening, wherein the condenser fan assembly is configured to translate between an operating position and a service position. The HVAC unit also includes a brace configured to extend from an enclosure of the HVAC unit to the condenser fan assembly to hold the condenser fan assembly in the service position.

The present disclosure also relates to a heating, ventilation, and/or air conditioning (HVAC) unit that includes a condenser fan assembly including a support frame and a condenser fan coupled to the support frame. The condenser fan assembly also includes a hinge configured to couple the condenser fan assembly to an enclosure of the HVAC unit, wherein the condenser fan assembly is configured to translate between an operating position and a service position. The HVAC unit further includes a brace configured to extend from the enclosure to the condenser fan assembly to hold the condenser fan assembly in the service position.

The present disclosure also relates to a heating, ventilation, and/or air conditioning (HVAC) unit that includes a condenser fan assembly including a support frame having an opening, where a condenser fan is coupled to the support frame and is configured to force air through the opening. The HVAC unit includes a plurality of hinges configured to attach the condenser fan assembly to an enclosure of the HVAC unit, where the condenser fan assembly is configured to translate between an operating position and a service position. The HVAC unit further includes a brace configured to extend from the enclosure to the condenser fan assembly to hold the condenser fan assembly in the service position.

BRIEF DESCRIPTION OF THE DRAWINGS

Various aspects of this disclosure may be better understood upon reading the following detailed description and upon reference to the drawings in which:

FIG. 14 is a side view of an embodiment of an HVAC unit having a wiring harness for condenser fans, in accordance with an aspect of the present disclosure.

DETAILED DESCRIPTION

Figure 1:
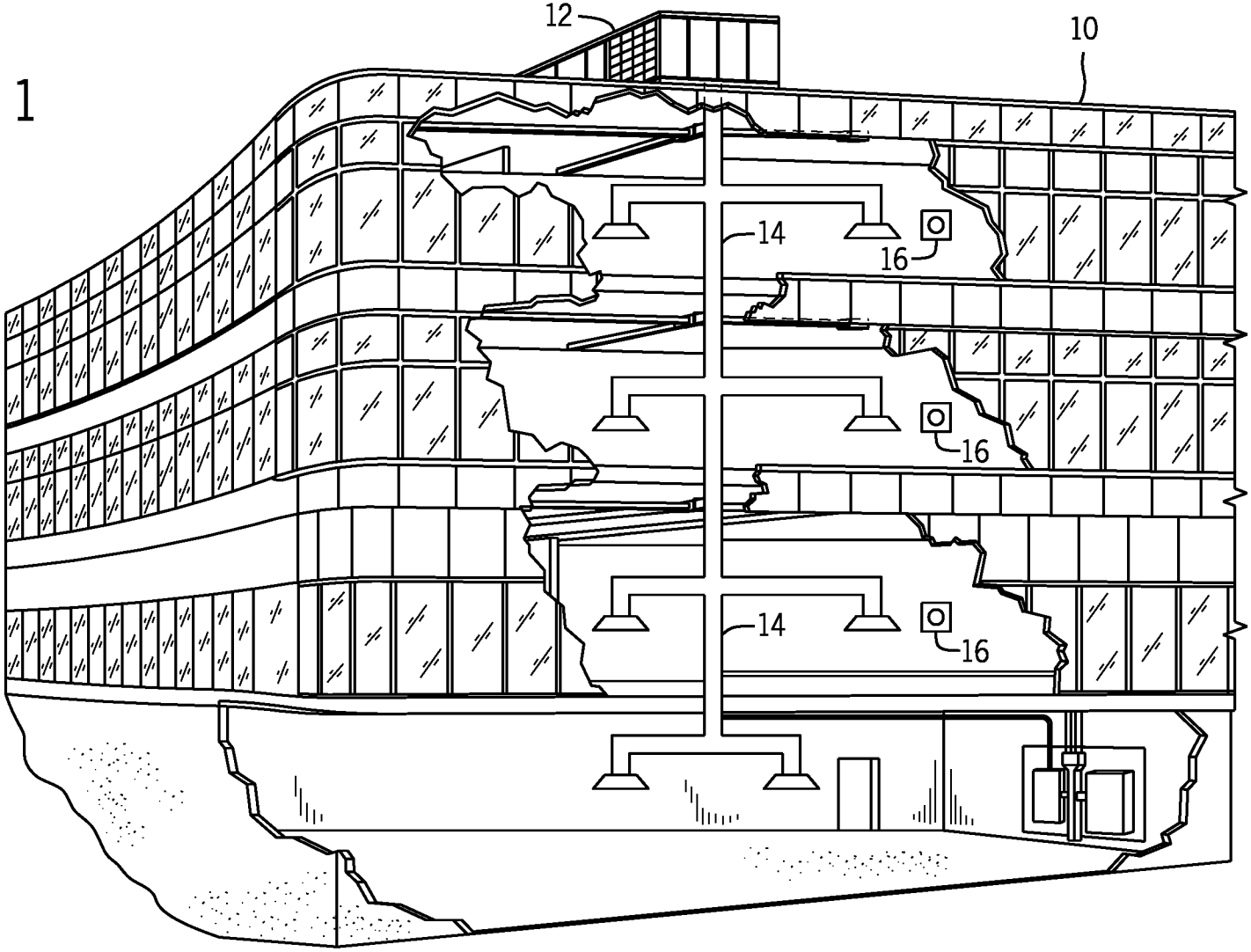
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) unit may be used to thermally regulate a space within a building, home, or other suitable structure. The HVAC unit typically includes an enclosure, also referred to herein as an HVAC enclosure, which houses internal components of the HVAC unit, such as a compressor, one or more HVAC controllers, heat exchangers, and/or any other suitable HVAC components. In many cases, the HVAC enclosure supports a condenser, which is configured to receive a flow of ambient air from the surrounding environment. In particular, a condenser fan assembly may be coupled to the enclosure and may be configured to draw or force an air flow across the condenser. For example, the condenser fan assembly may include a support frame having one or more flow passages formed therein, where the flow passages are in fluid communication with a heat exchange area of the condenser. A fan may be positioned within or adjacent to each of the flow passages and is configured to force a flow of ambient air through the flow passages and across the heat exchange area of the condenser. Accordingly, the condenser fan assembly may facilitate heat transfer between refrigerant circulating through the condenser and an ambient environment, such as the atmosphere.

As noted above, condenser fans of conventional HVAC units are often difficult to access, and significant disassembly of the HVAC unit may be involved to replace, inspect, or perform maintenance on the condenser fans and/or the condenser. Indeed, typical condenser fan assemblies may position the condenser fans within an interior of the HVAC enclosure, such that access to the condenser fans, the condenser, and/or components thereof is obstructed by panels of the HVAC enclosure and/or other HVAC components positioned adjacent to the condenser fans. As a result, maintenance operations on the condenser fans and/or condenser may be time consuming and may render the HVAC unit inoperable for a significant period of time.

It is now recognized that maintenance operations on the condenser fan(s) and/or condenser may be facilitated and improved by enabling access to the condenser fans and/or condenser without disassembly of the HVAC enclosure and/or removal of other HVAC system components that may be positioned adjacent to the condenser fans. Facilitating maintenance operations on the condenser fans and/or condenser may reduce a time period between non-operational periods of the HVAC unit, which may improve an overall efficiency of the HVAC unit and/or may reduce costs associated with HVAC system maintenance.

Accordingly, embodiments of the present disclosure are directed to a condenser fan assembly that is configured to translate, such as via pivoting, relative to the HVAC enclosure to enable removal of the condenser fans from the HVAC enclosure without involving traditional disassembly of HVAC enclosure. Specifically, the condenser fan assembly is configured to pivotably transition between an operating position, in which the condenser fans are positioned within an interior of the HVAC enclosure and are configured to draw or force an air flow across the condenser, and a service position, in which the condenser fans are positioned external to the enclosure. Particularly, in the service position, ample access to the condenser fans may be provided to enable maintenance, inspection, and/or replacement of the condenser fans. Additionally, when the condenser fan assembly is in the service position, access to the condenser within the HVAC enclosure may also be more readily enabled. Indeed, as discussed in detail herein, the condenser fan assembly is rapidly transitionable between the operating position and the service position, thereby reducing a time period that may be involved to perform maintenance or other operations on the condenser fans and/or the condenser. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
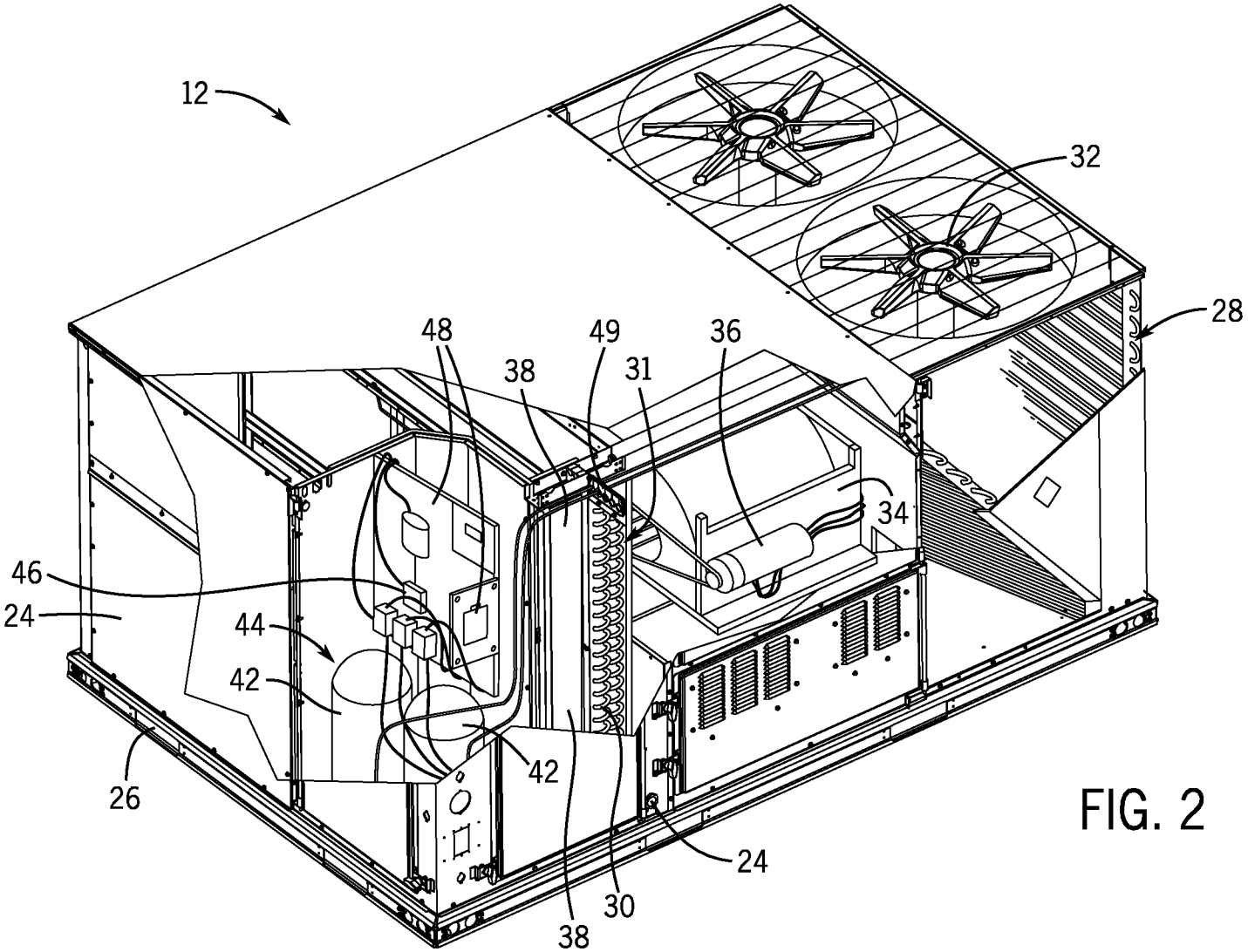
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
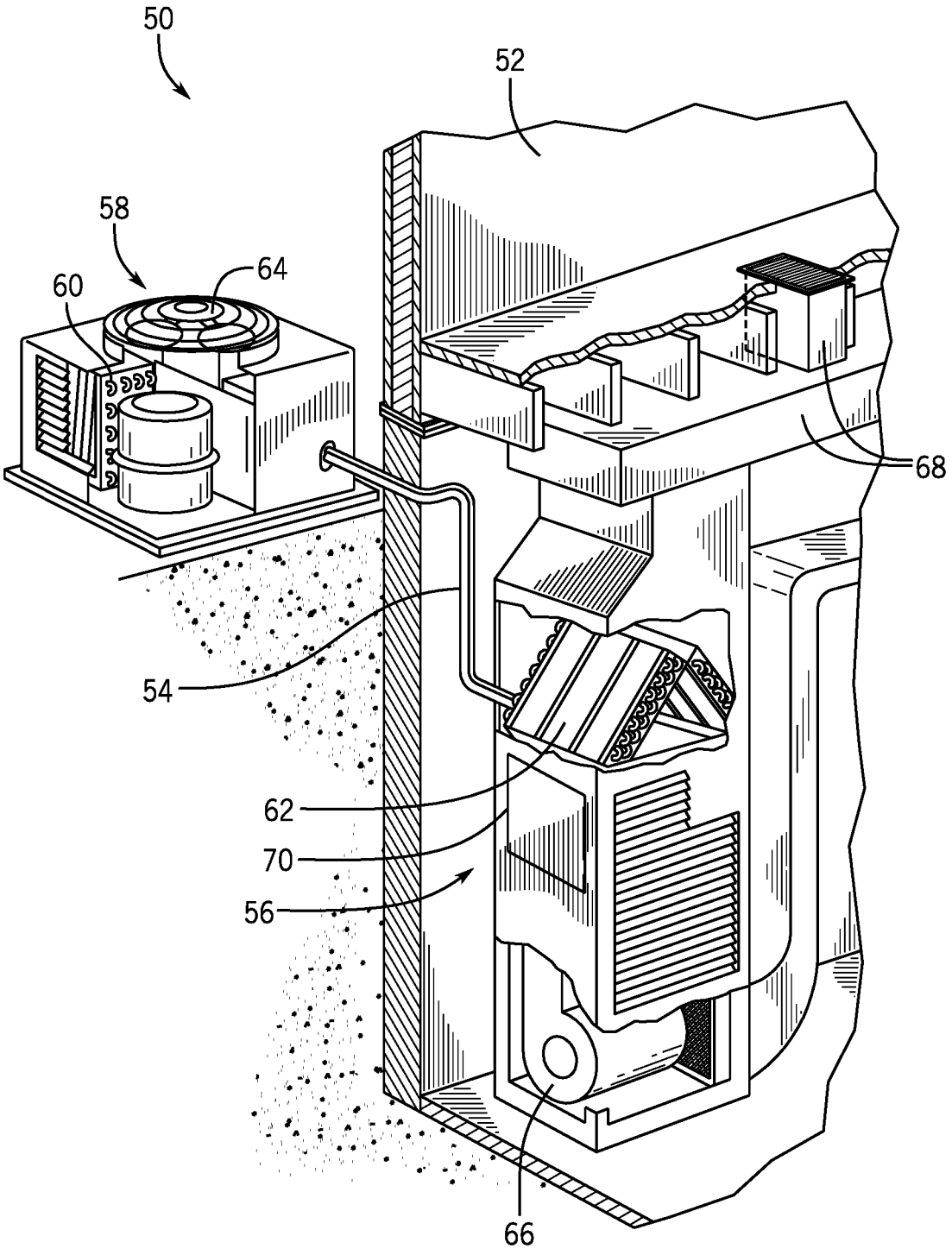
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
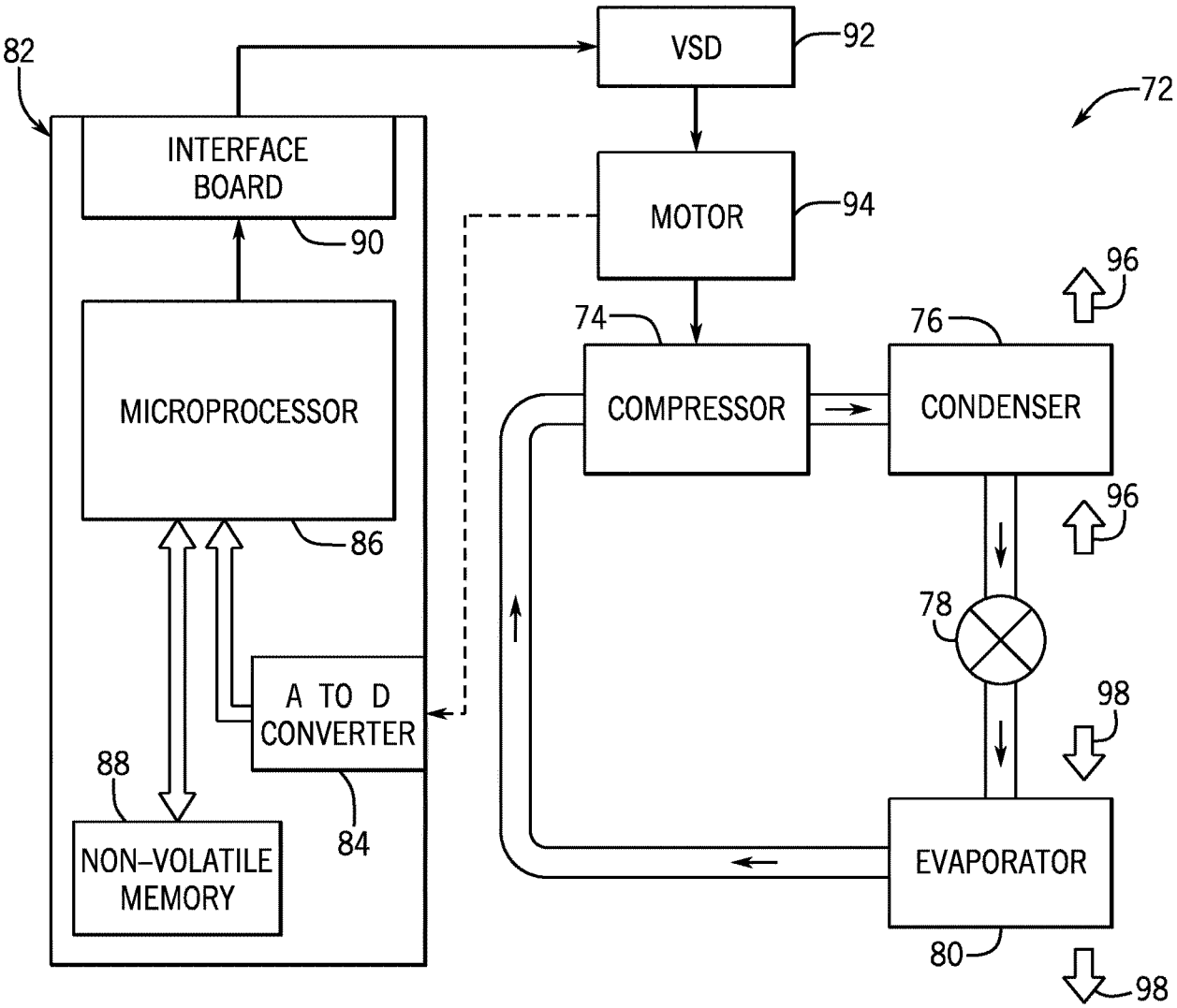
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC units generally include a condenser fan assembly having one or more condenser fans that are configured to draw or force an air flow across a condenser of the HVAC unit. Accordingly, the condenser fan assembly may facilitate heat transfer between a refrigerant circulating through the condenser and an ambient environment, such as the atmosphere. In many cases, condenser fans of typical HVAC units are positioned within an enclosure of the HVAC units. Therefore, condenser fans of conventional HVAC units are often difficult to access, and significant disassembly of the HVAC units may be involved to obtain access for maintenance and/or inspection of the condenser fans and/or condenser coils. For example, in typical HVAC units, removal of various panels and/or subassemblies of the HVAC enclosure may be expected in order to enable sufficient access for a service technician to perform maintenance operations on the condenser fan(s) and/or condenser coils. As a result, such maintenance operations may be time consuming and may therefore render the HVAC unit inoperable for a significant period of time. As noted above, embodiments of the present disclosure are therefore directed toward a translatable or pivotable condenser fan assembly that is configured to rapidly transition between an operating position, in which the condenser fans are positioned within an interior of the HVAC enclosure, and a service position, in which the condenser fans are positioned exterior of the HVAC enclosure to enable ample access for maintenance and/or inspection of the condenser fans and/or condenser coils.

Figure 5:
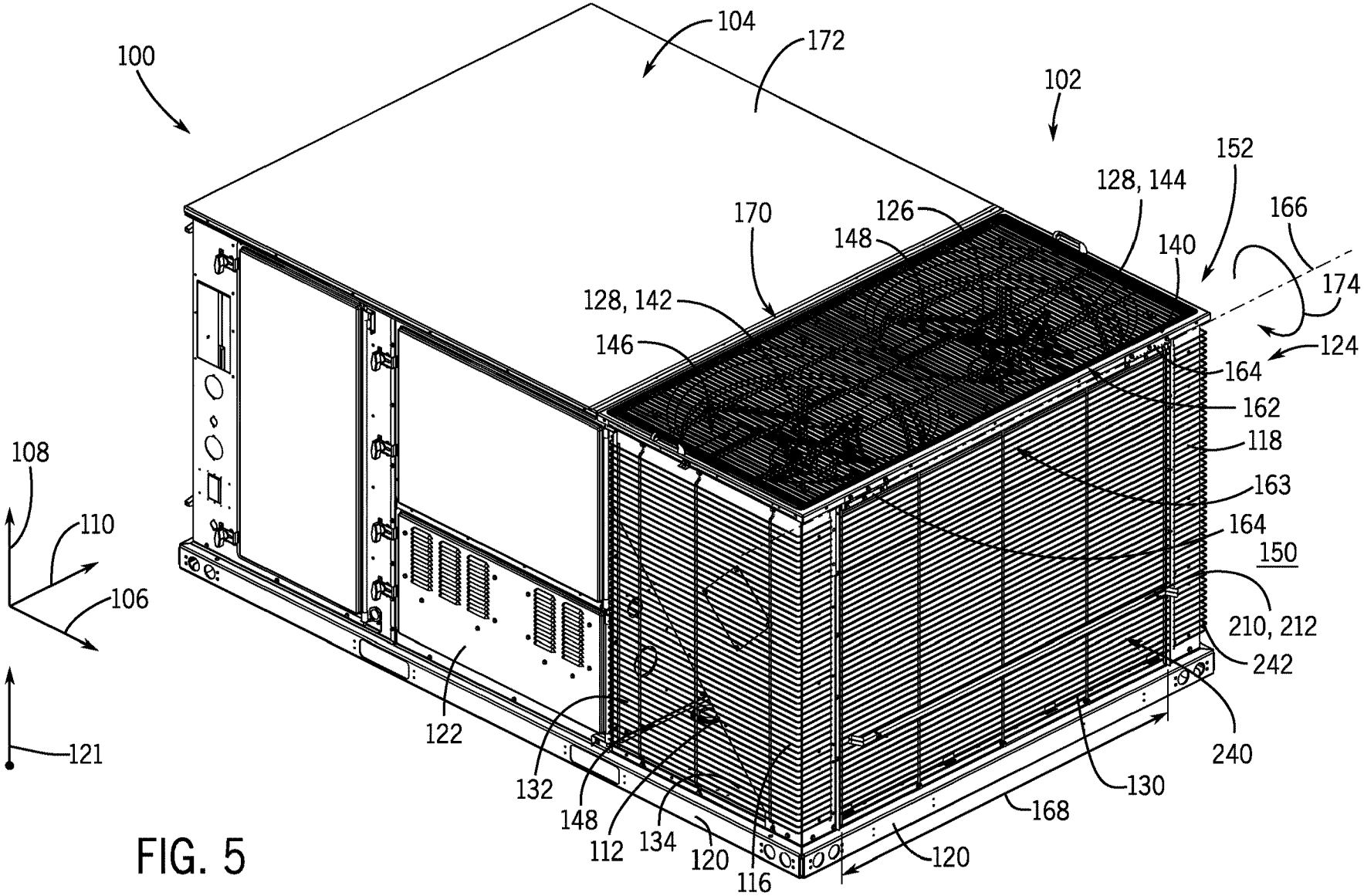
FIG. 5 is a perspective view of an embodiment of an HVAC unit having a pivotable condenser fan assembly in an operating position, in accordance with an aspect of the present disclosure.

For instance, FIG. 5 is a perspective view of an embodiment of an HVAC unit 100 having a condenser fan assembly 102 that is coupled to an enclosure 104 of the HVAC unit 100. For example, the condenser fan assembly 102 may be pivotably or rotatably coupled to the enclosure 104. It should be noted that the HVAC unit 100 may include embodiments or components of the HVAC unit 12 shown in FIG. 2, embodiments or components of the split, residential heating and cooling system 50 shown in FIG. 3, a rooftop unit (RTU), or any other suitable HVAC unit or HVAC system. To facilitate discussion, the HVAC unit 100 and its components will be described with reference to a longitudinal axis 106, a vertical axis 108, and a lateral axis 110. The enclosure 104 is configured to house and/or support a condenser 112 or a condenser coil of the HVAC unit 100 which, as discussed in detail below, is configured to receive an air flow from an ambient environment, such as the atmosphere. For example, in some embodiments, the condenser 112 may be coupled to and positioned between a first side panel 116 and a second side panel 118 of the enclosure 104, which are configured to support and orient the condenser 112 in a slanted configuration with respect to base rails 120 of the enclosure 104. The enclosure 104 may also include a central housing 122 that is configured to shield, for example, a compressor, a blower, one or more HVAC controllers, and/or any other suitable components of the HVAC unit 100 from direct exposure to ambient environmental elements, such as precipitation or ultraviolet radiation.

In some embodiments, the condenser fan assembly 102 and the condenser 112 may form a portion of a condenser section 124 of the enclosure 104, which may be positioned adjacent to the central housing 122. As discussed below, the condenser section 124 may include an interior space, referred to herein as a chamber 126, which enables one or more condenser fans 128 to draw a flow of ambient atmospheric air across the condenser 112. The condenser section 124 may include an end panel 130 that extends from the base rails 120 in a first direction 121, generally parallel to the vertical axis 108, and spans between the first side panel 116 and the second side panel 118 of the enclosure 104. Accordingly, the end panel 130 may form a lateral end portion of the enclosure 104.

In some embodiments, the first and second side panels 116, 118 may be coupled to a divider panel 132 that defines an interface between the central housing 122 and the condenser section 124. The condenser 112 may extend between the divider panel 132 and a lower panel 134 of the enclosure 104 and span along respective portions of the first and second side panels 116, 118. A support frame 140 of the condenser fan assembly 102 may extend between the divider panel 132, the end panel 130, and the first and second side panels 116, 118, thereby defining a boundary of the chamber 126, which extends between the condenser 112, the end panel 130, a portion of the divider panel 132, and the first and second side panels 116, 118.

In the illustrated embodiment, the condenser fan assembly 102 includes a first condenser fan 142 and a second condenser fan 144 that are coupled to the support frame 140 and are configured to force an air flow through chamber 126 and across the condenser 112. For example, the first condenser fan 142 and the second condenser fan 144 are positioned within a first passage 146 and a second passage 148, respectively, defined within the support frame 140. In some embodiments, the first and second condenser fans 142, 144 may be configured to force air along and through the passages 146, 148 in the first direction 121 to discharge air from the chamber 126. Accordingly, the first and second condenser fans 142, 144 may generate a region of relatively low pressure within the chamber 126 that may be less than an ambient atmospheric pressure surrounding the chamber 126. As a result, this pressure difference may force higher pressure ambient air across a heat exchange area the condenser 112 and into the chamber 126. In this manner, the first and second condenser fans 142, 144 may draw a flow of ambient air across the condenser 112 and, thus, enable the ambient air to absorb thermal energy from a refrigerant circulating therethrough.

In particular, the generated pressure differential between the chamber 126 and the ambient environment may force ambient air into respective inlet ports 148 formed on either side of the condenser section 124, across a heat exchange area of the condenser 112, and into the chamber 126. Upon entering the chamber 126, the condenser fans 142, 144 may discharge the ambient air through the first and second passages 146, 148 as heated exhaust air. Accordingly, the condenser fan assembly 102 may facilitate heat exchange between the refrigerant circulating through the condenser 112 and an ambient environment 150, thereby increasing an overall operational efficiency of the condenser 112. Although two condenser fans 142, 144 are shown in the illustrated embodiment, it should be noted that, in other embodiments, the condenser fan assembly 102 may include any suitable quantity of condenser fans 142, 144. As an example, the condenser fan assembly 102 may include 1, 2, 3, 4, 5, 6, or more than 6 condenser fans that are positioned within or adjacent to respective passages of the support frame 140.

In the illustrated embodiment, the support frame 140 is positioned in an operating position 152, in which the condenser fans 142, 144 are positioned within the chamber 126 and are configured to direct an air flow across the condenser 112. That is, the condenser fans 142, 144 are positioned within an interior of the enclosure 104, such that access to the condenser fans 142, 144 and/or the condenser 112 may be obstructed by certain portions or panels of the enclosure 104. For example, the first and second side panels 116, 118, the end panel 130, and/or the condenser 112 may obstruct access to respective motors, bearings, and fan blades of the first and second condenser fans 142, 144. Therefore, the HVAC unit 100 is equipped with the condenser fan assembly 102 of the present disclosure, which is configured pivot relative to the enclosure 104 between the operating position 152 and a service position 160, as discussed below with reference to FIG. 10, in which the condenser fans 142, 144 may be extracted from the chamber 126 or, in other words, removed from an interior of the enclosure 104. Accordingly, in the service position 160, a service technician may have ample access to the first and second condenser fans 142, 144 to perform maintenance or other operations on the condenser fans 142, 144 without involving disassembly of the enclosure 104. When the condenser fan assembly 102 is in the service position 160, the condenser 112 is also exposed and more readily accessed.

For example, a first lateral side wall 162, also referred to herein as a first lateral side, of the support frame 140 may be hingedly coupled to a lateral end portion 163 of the enclosure 104 via one or more hinges 164. The hinges 164 enable the condenser fan assembly 102 to pivot relative to the enclosure 104 between the operating position 152 and the service position 160. Specifically, the hinges 164 enable the condenser fan assembly 102 to pivot about an axis 166 of the hinges 164 that extends along a width 168 of the end panel 130, generally parallel to the lateral axis 110. The hinges 164 enable a second lateral side wall 170, also referred to herein as a second lateral side, of the condenser fan assembly 102, opposite to the first lateral side wall 162, to be positioned to adjoin the enclosure 104 in the operating position 152. For example, in some embodiments, the second lateral side wall 170 may abut the divider panel 132 and/or a top panel 172 of the enclosure 104 in the operating position 152. Additionally, as discussed in detail below, by enabling the support frame 140 to rotate about the axis 166 relative to the enclosure 104 in a clockwise direction 174, the hinges 164 enable the second lateral side wall 170 to be positioned distal to the enclosure 104 in the service position 160.

Figure 6:
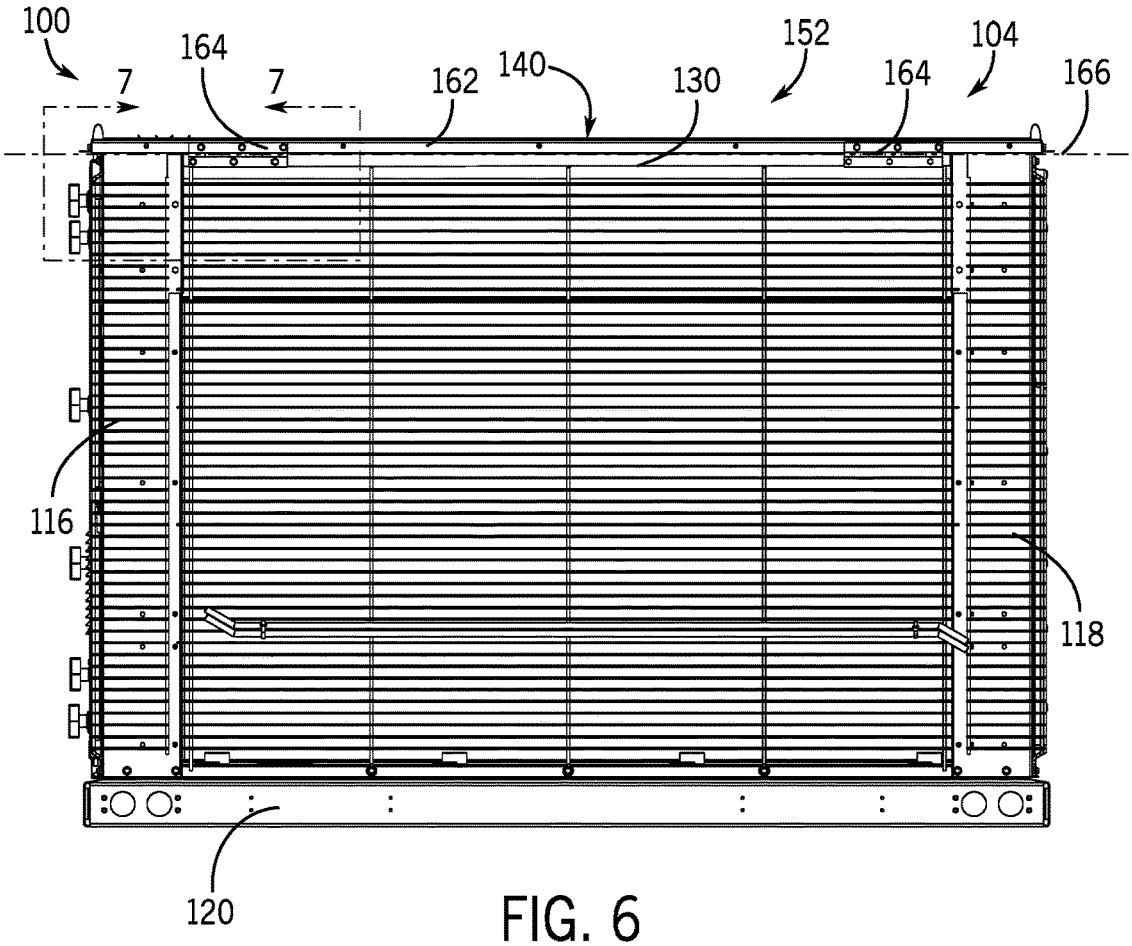
FIG. 6 is a front view of an embodiment of an HVAC unit having a pivotable condenser fan assembly, in accordance with an aspect of the present disclosure.
Figure 7:
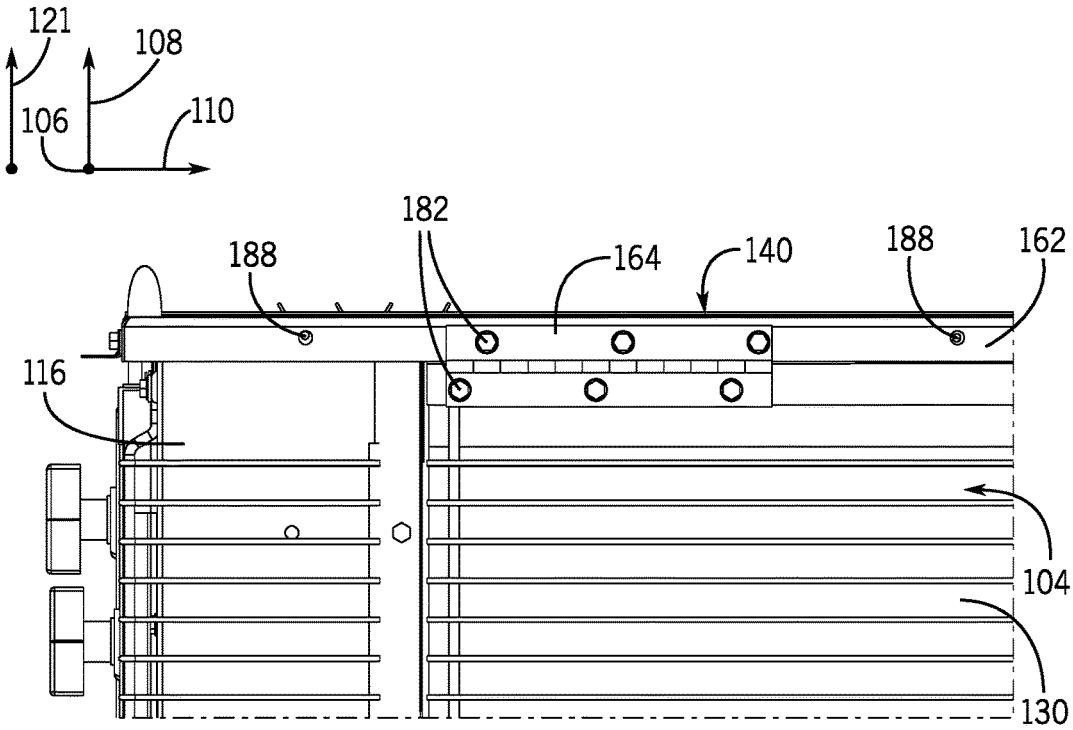
FIG. 7 is a partial front view of an embodiment of an HVAC unit, taken within line 7-7 of FIG. 6, having a pivotable condenser fan assembly, in accordance with an aspect of the present disclosure.

To better illustrate the engagement between the hinges 164, the enclosure 104, and the support frame 140, FIG. 6 is a front view of an embodiment of the HVAC unit 100, and FIG. 7 is an expanded view, taken with line 7-7 of FIG. 6, of the front view of the embodiment of the HVAC unit 100. FIGS. 6 and 7 are discussed concurrently below. As shown in the illustrated embodiment, suitable fasteners 182 may couple the hinges 164 to the first lateral side wall 162 of the support frame 140 and, for example, to the end panel 130 of the enclosure 104. Accordingly, the hinges 164 enable the support frame 140 to pivot relative to the enclosure 104 about the axis 166. Although the HVAC unit 100 includes two hinges 164 in the illustrated embodiment, it should be noted that, in other embodiments, any suitable quantity of hinges 164 may be used to pivotably couple the support frame 140 to the enclosure 104. For example, in some embodiments, a quantity of the hinges 164, a type of the hinges 164, and/or a size of the hinges 164 may be selected based on a size of the HVAC unit 100 and/or a size of the condenser fan assembly 102. Particularly, HVAC units 100 having a relatively small condenser fan assembly 102 may be equipped with fewer hinges 164 and/or smaller hinges 164 than, for example, HVAC units 100 having a relatively large condenser fan assembly 102.

Further, it should be noted that, in some embodiments, the hinges 164 may be formed integrally with the support frame 140 and with a portion of the enclosure 104, such as, for example, the end panel 130. That is, the hinges 164 may not include separate components that are coupled to the support frame 140 and to the enclosure 104 via suitable fasteners and/or adhesives. For example, in certain embodiments, the support frame 140 may include one or more integrated hinge barrels or tubes that are formed within and extend from the first lateral side wall 162 of the support frame 140. A suitable portion of the enclosure 104, such as the end panel 130, may also include one or more respective integrated hinge barrels or tubes formed therein, which are configured to engage with corresponding hinge barrels of the support frame 140. That is, in some embodiments, an interior of the hinge barrels of the support frame 140 may be configured to align substantially collinear to an interior of the hinge barrels of the end panel 130. Accordingly, a pin or rod may be configured to extend through the interior of the integrated hinge barrels of the support frame 140 and the interior of the integrated hinge barrels of the end panel 130, such that the pin or rod may pivotably couple the support frame 140 to the end panel 130. In other embodiments, the support frame 140 and, for example, the end panel 130, may include any other suitable integrated hinge feature or hinge connection that is configured to pivotably or hingedly couple the support frame 140 to the end panel 130. Therefore, it should be appreciated that any suitable hinged connection may be used to hingedly or pivotably couple the support frame 140 to the enclosure 104 in addition to, or in lieu of, the hinges 164.

In some embodiments, the HVAC unit 100 may include a plurality of mounting fasteners 188 that are configured to maintain the condenser fan assembly 102 in the operating position 152 during normal operational periods of HVAC unit 100. Particularly, the fasteners 188 may extend through the first lateral side wall 162 and fixedly couple the support frame 140 to the enclosure 104. In some embodiments, the fasteners 188 may also be positioned about a perimeter of the support frame 140, or about a portion of the perimeter of the support frame 140, and may be configured to couple respective side walls of the support frame 140 to the enclosure 104. That is, the fasteners 188 may couple the first lateral side wall 162, the second lateral side wall 170, and/or longitudinal side walls of the support frame 140, which may extend between the first and second lateral side walls 162, 170, to the enclosure 104.

Figure 8:
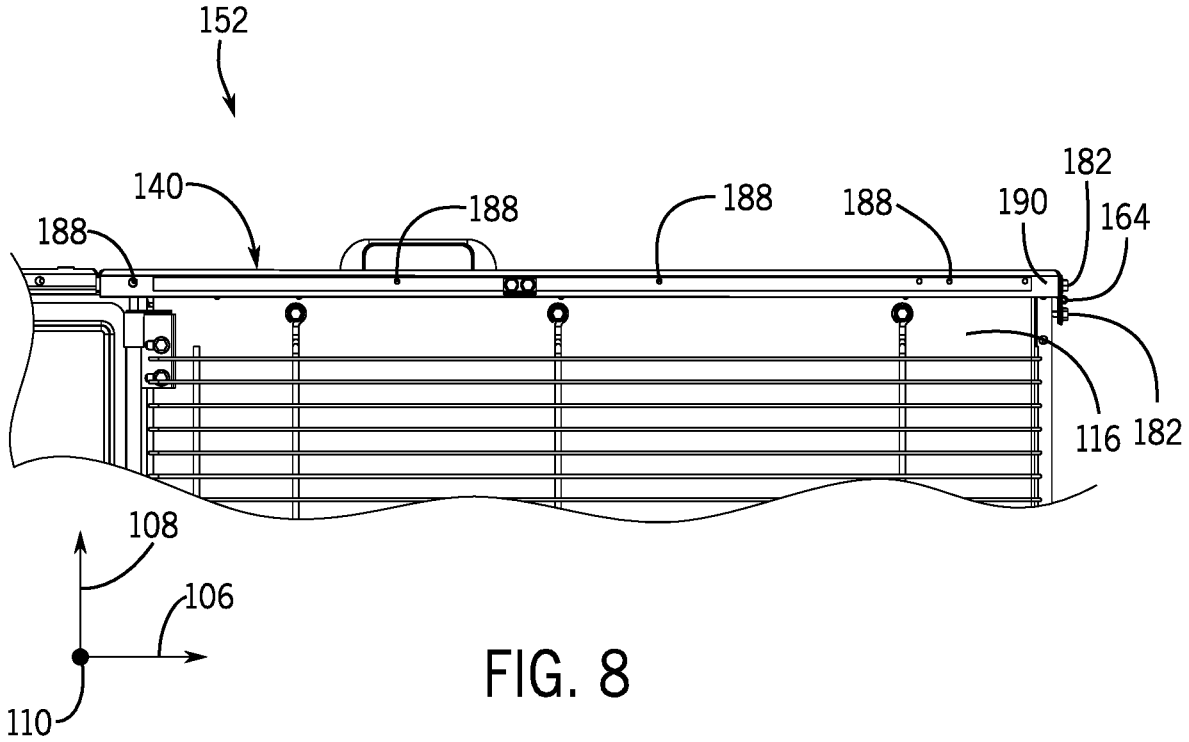
FIG. 8 is a side view of an embodiment of a pivotable condenser fan assembly for an HVAC unit, in accordance with an aspect of the present disclosure.

FIG. 8 is a side view of an embodiment of the condenser section 124, illustrating a first set of the fasteners 188 that are configured to couple a longitudinal side wall 190 of the support frame 140 to the first side panel 116 of the enclosure 104. It should be noted that, in some embodiments, a second set of the fasteners 188 may couple an additional longitudinal side wall of the support frame 140, which is opposite to the longitudinal side wall 190, to the second side panel 118 of the enclosure 104. In any case, prior to transition of the condenser fan assembly 102 from the operating position 152 to the service position 160, a service technician may remove the fasteners 188 and, thus, unfasten the longitudinal side wall 190 from the first side panel 116 to enable the condenser fan assembly 102 to rotate freely about the axis 166 via the hinges 164. Fasteners 188 coupling an additional longitudinal side wall from the second side panel 118 may similarly be removed to unfasten the additional side wall from the second side panel 118 prior to transition of the condenser fan assembly 102 from the operating position 152 to the service position 160.

Figure 9:
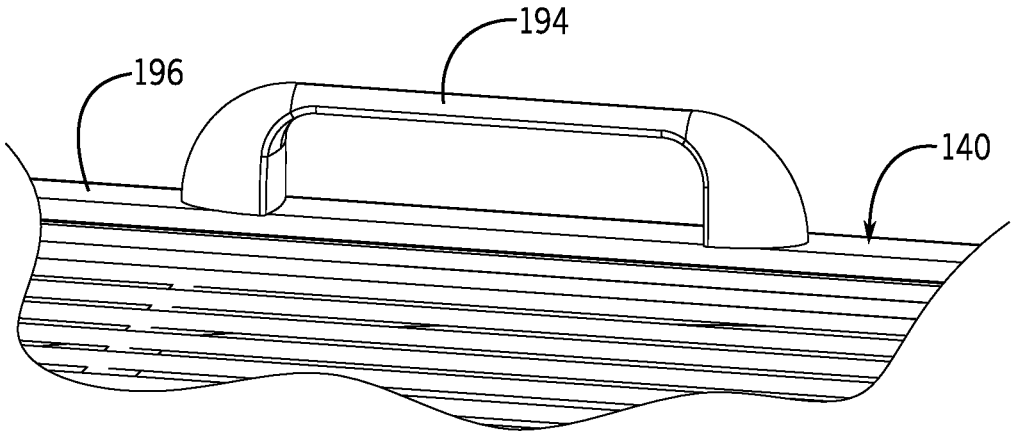
FIG. 9 is a perspective view of an embodiment of a handle for a pivotable condenser fan assembly, in accordance with an aspect of the present disclosure.

FIG. 9 is a perspective view of an embodiment of a handle 194 that may be coupled to, for example, a top surface 196 of the support frame 140. As discussed in detail below, the handle 194 may facilitate transition of the condenser fan assembly 102 from the operating position 152 to the service position 160, and vice versa, by an operator. That is, the handle 194 may enable a service technician to pivot the support frame 140 about the axis 166. It should be noted that the support frame 140 may include a single handle 194 or multiple handles 194 coupled thereto.

Figure 10:
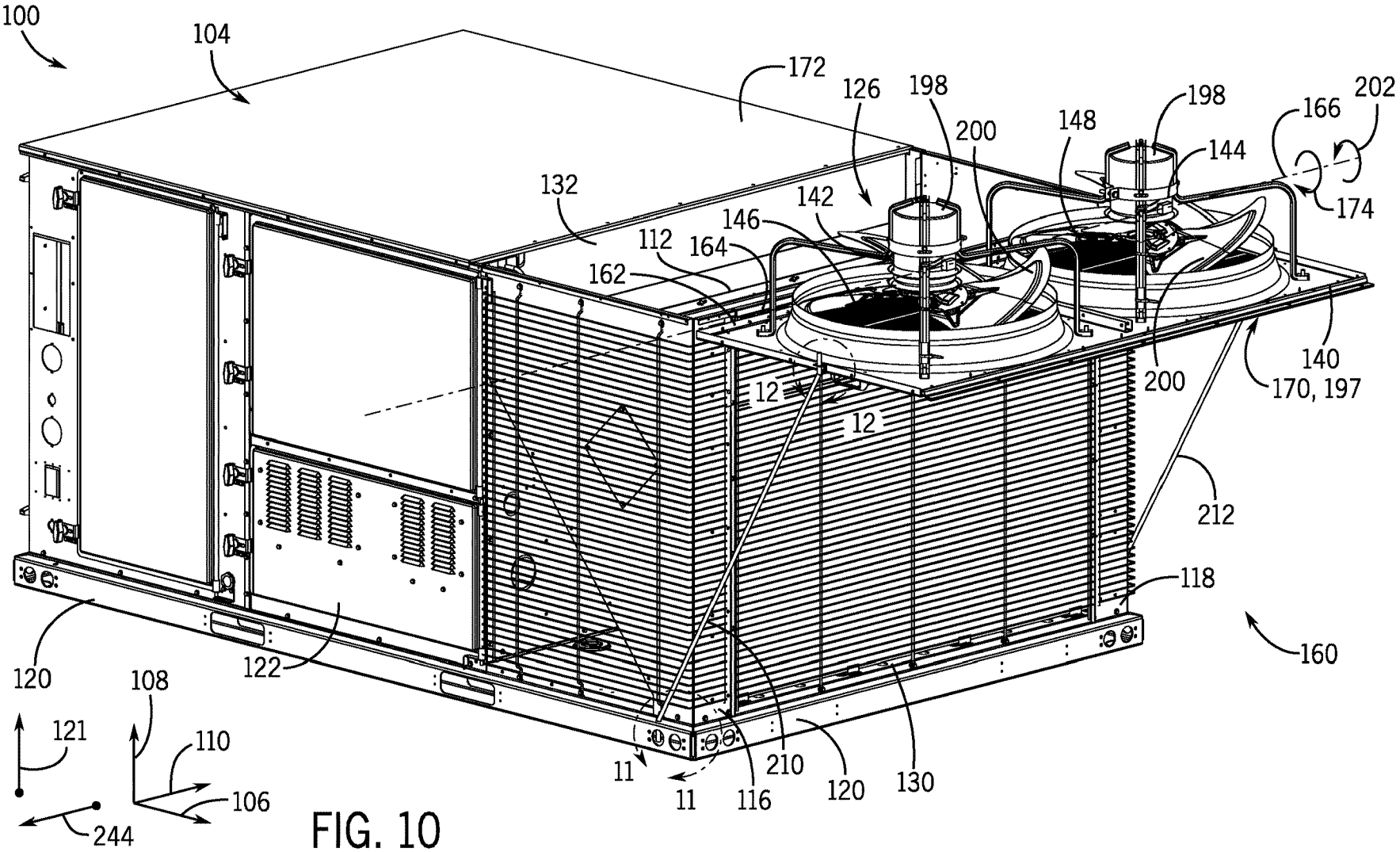
FIG. 10 is a perspective view of an embodiment of an HVAC unit having a pivotable condenser fan assembly in a service position, in accordance with an aspect of the present disclosure.
Figure 11:
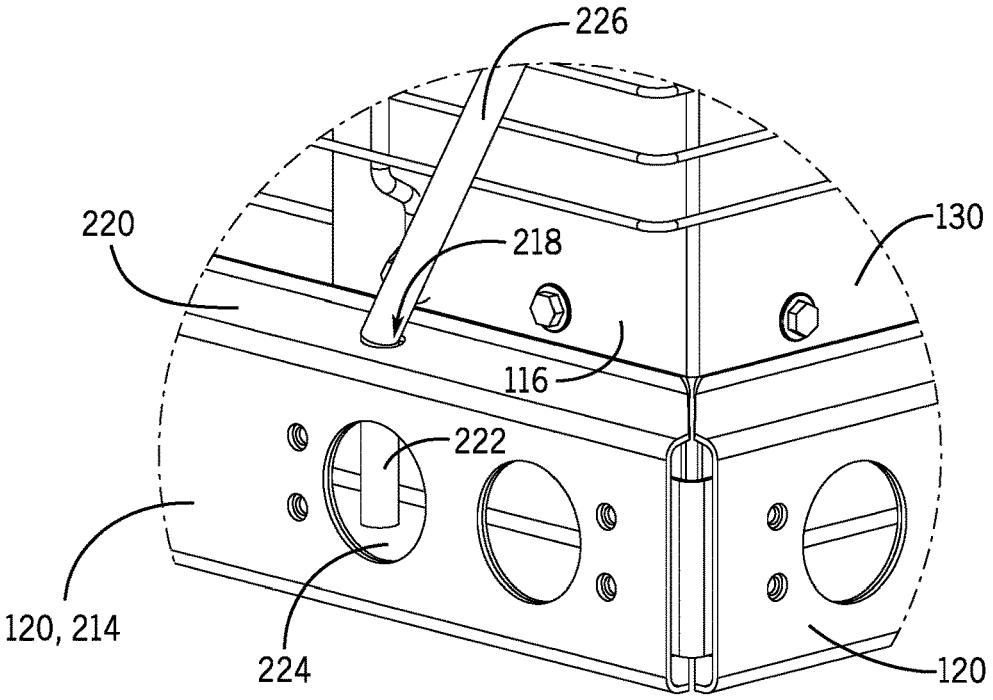
FIG. 11 is a partial perspective view of an embodiment of an HVAC unit, taken within line 11-11 of FIG. 10, having a pivotable condenser fan assembly in a service position, in accordance with an aspect of the present disclosure.
Figure 12:
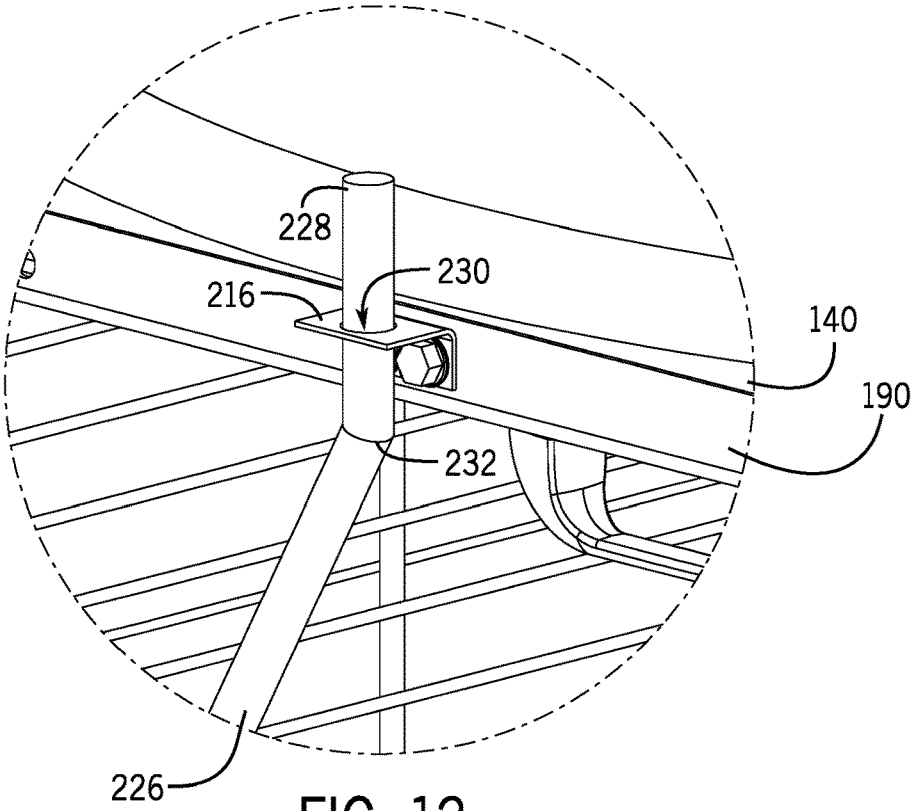
FIG. 12 is a partial perspective view of an embodiment of an HVAC unit, taken within line 12-12 of FIG. 10, having a pivotable condenser fan assembly in a service position, in accordance with an aspect of the present disclosure.

FIG. 10 is a perspective view of an embodiment of the HVAC unit 100 in which the condenser fan assembly 102 is positioned in the service position 160. FIG. 11 is an expanded view, taken with line 11-11 of FIG. 10, of the HVAC unit 100, and FIG. 12 is an expanded view taken within line 12-12 of FIG. 10, of the HVAC unit 100, illustrating additional details of the HVAC unit 100. FIGS. 10-12 are discussed concurrently below. As shown in the illustrated embodiment, in the service position 160 of the condenser fan assembly 102, the second lateral side wall 170 of the support frame 140 may extend in a direction away from the enclosure 104 and may thus define a distal end 197 of the enclosure 104. For example, in some embodiments, in the service position 160, the condenser fan assembly 102 may be rotated approximately 180 degrees, plus or minus approximately 10 degrees, about the axis 166 in the clockwise direction 174 with respect to the operating positing 152. Such pivotal motion of the condenser fan assembly 102 enables the support frame 140 and the first and second condenser fans 142, 144 to rotate out of the chamber 126, thereby positioning the support frame 140 and the condenser fans 142, 144 external to the enclosure 104. As a result, a service technician may have ample access to inspect, replace, and/or perform maintenance on the condenser fans 142, 144 and/or components of the condenser fans 142, 144. Indeed, as shown in the illustrated embodiment, respective motors 198 and respective fan rotors 200 of the condenser fans 142, 144 may be completely extracted from an interior of the enclosure 104 in the service position 160 of the condenser fan assembly 102, thereby facilitating access to these components. Additionally, with the condenser fan assembly 102 in the service position 160, the chamber 126 of the condenser section 124 is exposed, and the components disposed therein, such as the condenser 112, are more readily accessible for maintenance or other procedures.

To return the condenser fan assembly 102 to the operating position 152 from the service position 160, a service technician may rotate the condenser fan assembly 102 in a counter-clockwise direction 202, about the axis 166, until the second lateral side wall 170 engages with, for example, the divider panel 132 and/or the top panel 172 of the enclosure 104. Indeed, the service technician may use the handle 194 described above to transition the condenser fan assembly 102 between the operating and service positions 152, 160. It should be noted that, in other embodiments, a suitable actuator, such as a linear actuator, a hydraulic actuator, or a pneumatic actuator, may be configured to transition the condenser fan assembly 102 between the operating position 152 and the service position 160. Such an actuator may be used to pivot the condenser fan assembly 102 about the axis 166 in addition to, or in lieu of, manual input that may be provided by the service technician via the handle 194.

Although the operating position 152 and the service position 160 have been described as approximately 180 degrees apart from one another relative to the axis 166, it should be appreciated that, in other embodiments, the operating position 152 and the service position 160 may be offset from one another by any other suitable angular increment. As a non-limiting example, in some embodiments, the service position 160 of the condenser fan assembly 102 may be offset by between about 45 degrees and about 270 degrees, in the clockwise direction 174, about the axis 166 from the operating position 152.

In the illustrated embodiment, the HVAC unit 100 includes a first brace 210 and a second brace 212 that are actuatably attachable to the enclosure 104 and configured to support the condenser fan assembly 102 in the service position 160. For conciseness, only the engagement between the first brace 210 and the HVAC unit 100 will be described below with reference to FIGS. 10-12. However, it should be noted that the second brace 212 may engage with corresponding portions of the HVAC unit 100 in a substantially similar manner as the first brace 210. Moreover, it should be appreciated that, in certain embodiments, only one of the first brace 210 and the second brace 212 may be used to support the condenser fan assembly 102 in the service position 160.

As shown in the illustrated embodiment, the first brace 210 is configured to extend, in particular, between a longitudinal base rail 214 of the enclosure 104 and a mounting tab 216 or bracket of the support frame 140. For clarity, the longitudinal base rail 214 and the mounting tab 216 are also referred to herein as a first mount and a second mount, respectively. The longitudinal base rail 214 includes a hole 218 formed within a top panel 220 of the longitudinal base rail 214. The hole 218 is configured to receive a first mounting portion 222 of the first brace 210, which is configured to extend through the hole 218 and, in some embodiments, rest on a lower panel 224 of the longitudinal base rail 214. The first brace 210 includes a central portion 226 that extends at an angle from the first mounting portion 222 and to a second mounting portion 228 of the first brace 210. The second mounting portion 228 may extend generally parallel to the first mounting portion 222 and is configured to extend through an aperture 230 formed within the mounting tab 216. Accordingly, as discussed below, the mounting tab 216 may rest on an interface 232 of the first brace 210 that is formed between the central portion 226 and the second mounting portion 228.

In some embodiments, the mounting tab 216 may be a separate component of the support frame 140 that is coupled to the longitudinal side wall 190 of the support frame 140 via a suitable adhesive and/or fastener. In other embodiments, the mounting tab 216 may be integrally formed with the support frame 140. In further embodiments, the second mounting portion 228 may engage directly with an aperture formed within the support frame 140 itself, such that the mounting tab 216 may be omitted from the condenser fan assembly 102.

In any case, first mounting portion 222 and the second mounting portion 228 enable the first brace 210 to toollessly engage with the longitudinal base rail 214 and the mounting tab 216, respectively. Accordingly, a service technician may install the first brace 210 on the HVAC unit 100 without the use of dedicated or specialized tools or other equipment. For example, upon transitioning the condenser fan assembly 102 from the operating position 152 to the service position 160, the service technician may insert the first mounting portion 222 of the first brace 210 into the hole 218 of the longitudinal base rail 214 while manually supporting the condenser fan assembly 102. Next, the service technician may pivot the condenser fan assembly 102 by a relatively small angular increment in the counter-clockwise direction 202 about the axis 166 to allow for alignment of the second mounting portion 228 with the aperture 230 of the mounting tab 216. Thereafter, the service technician may again pivot the condenser fan assembly 102 in the clockwise direction 174 about the axis 166, such that the second mounting portion 228 extends through the aperture 230, and the mounting tab 216 lowers into engagement with the interface 232 of the first brace 210. Accordingly, upon engaging the mounting tab 216 with the interface 232, the first brace 210 may retain the condenser fan assembly 102 in the service position 160. That is, the interface 232 may block pivotal motion of the condenser fan assembly 102 in the clockwise direction 174 about the axis 166. In order to transition the condenser fan assembly 102 back from the service position 160 to the operating position 152, and to toollessly remove the first brace 210 from the longitudinal base rail 214 and the mounting tab 216, the reverse order of the steps described above may be completed.

In some embodiments, the first brace 210, the second brace 212, or both, may be coupled to an exterior of the enclosure 104 in a storage position 240, as shown in FIG. 5, such as during normal operation of the HVAC unit 100. For example, in certain embodiments, one or more cable ties or other suitable fasteners may be used to couple the first and second braces 210, 212 to a grill 242 of the enclosure 104 and thereby secure the first and second braces 210, 212 in the storage position 240. As such, the first and second braces 210, 212 are quickly retrievable and ready for installation on the HVAC unit 100 when transitioning the condenser fan assembly 102 from the operating position 152 to the service position 160.

Although the hinges 164 have been described as hingedly or pivotably coupling the condenser fan assembly 102 to the end panel 130 of the enclosure 104, in other embodiments, the hinges 164 may be configured to hingedly couple the condenser fan assembly 102 to the first side panel 116, the second side panel 118, or the divider panel 132. For example, in embodiments where the condenser fan assembly 102 is hingedly coupled to the first side panel 116, the condenser fan assembly 102 may be configured to transition between the operating position 152 and a corresponding service position via pivotal motion about an axis that is generally parallel to the longitudinal axis 106. In such embodiments, the first and second braces 210, 212 may both engage with the longitudinal base rail 214 and may diverge from the first side panel 116 in a second direction 244 that may extend generally parallel to the lateral axis 110. Accordingly, the first and second braces 210, 212 may engage with and support the condenser fan assembly 102 in the corresponding service position of the condenser fan assembly 102.

Figure 13:
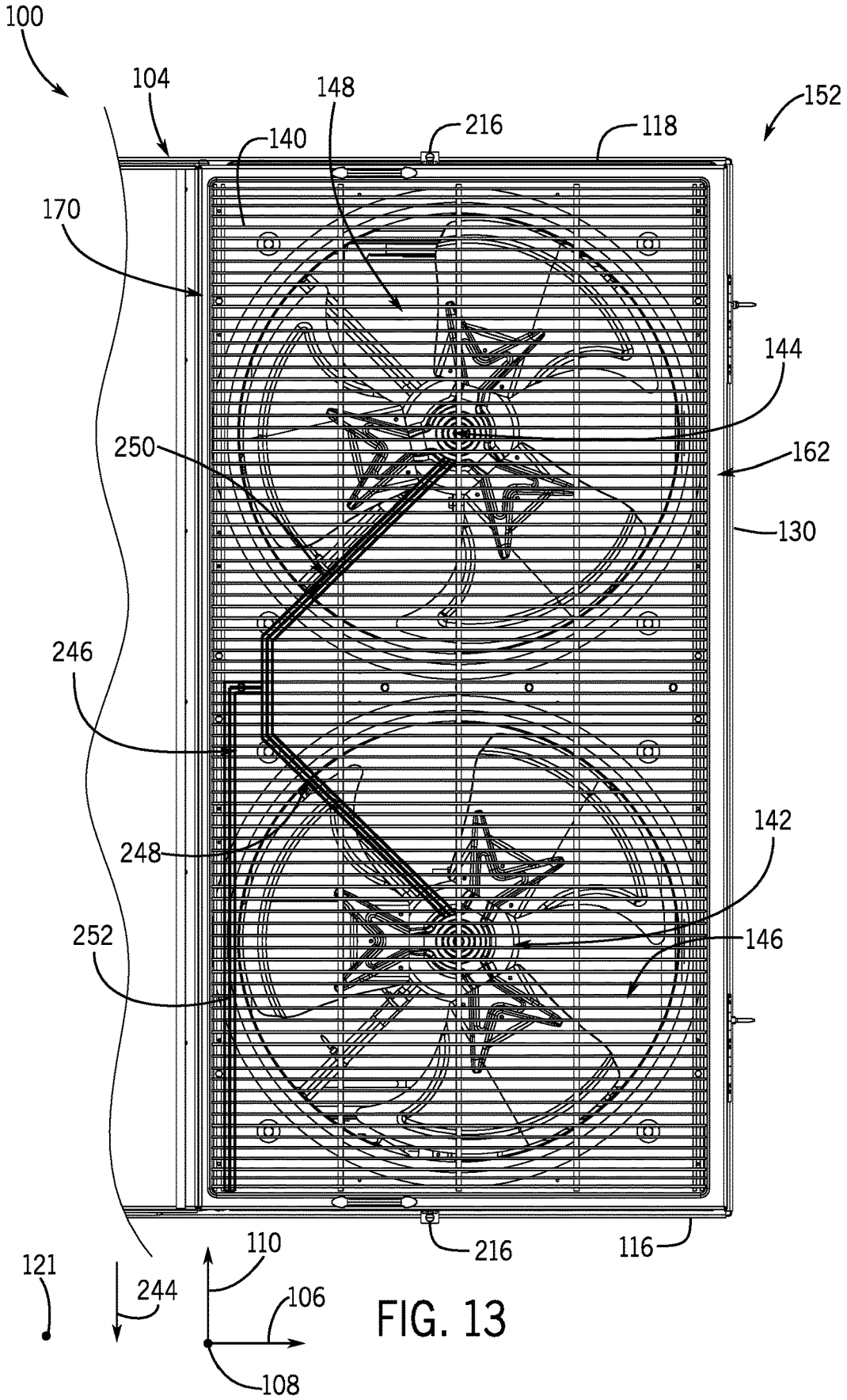
FIG. 13 is a top view of an embodiment of an HVAC unit having a wiring harness coupled to a pivotable condenser fan assembly, in accordance with an aspect of the present disclosure.

FIG. 13 is a top view of an embodiment of the HVAC unit 100 in which the condenser fan assembly 102 is in the operating position 152. In some embodiments, the HVAC unit 100 includes a wiring harness 246 that may be used to electrically couple the condenser fans 142, 144 to, for example, the control panel 82 to enable the control panel 82 to adjust operational parameters of the condenser fans 142, 144, such an operational speed of the condenser fans 142, 144. In some embodiments, the wiring harness 246 may include a first set of connection wires 248 associated with the first condenser fan 142 and a second set of connection wires 250 associated with the second condenser fan 144, each of which is electrically coupled to a central wire set 252 of the wiring harness 246. In some embodiments, the first set of connection wires 248, the second set of connection wires 250, and the central wire set 252 may each be coupled to the support frame 140. Particularly, cable ties, suitable adhesives, or fasteners may be used to couple the wiring harness 246 and associated wire sets to the support frame 140. As shown in the illustrated embodiment, the central wire set 252 may extend along the support frame 140 in the second direction 244 toward the first side panel 116 of the enclosure 104.

To facilitate the subsequent discussion, FIG. 14 is a side view of an embodiment of the HVAC unit 100. In some embodiments, the central wire set 252 may terminate at a plug 256, such as a Molex type connector plug, which is configured to engage with a corresponding plug 258 of an additional wiring harness 260 of the HVAC unit 100. The plugs 256, 258 enable the wiring harness 246 to electrically and physically couple to or electrically and physically decouple from the wiring harness 260. Therefore, the plugs 256, 258 enable the condenser fan assembly 102 to pivot from the operating position 152 to the service position 160 without interference by the wiring harnesses 246, 260. For example, in some embodiments, the plugs 265, 258 may be accessible through an access panel 264 of the HVAC unit 100, thereby enabling a service technician to disconnect the plugs 256, 258 from one another before transitioning the condenser fan assembly 102 from the operating position 152 to the service position 160. Accordingly, in a disconnected configuration of the plugs 256, 258, the wiring harness 246 may rotate with the support frame 140 between the operating position 152 and the service position 160 independently of the wiring harness 260. However, in certain embodiments, the wiring harness 246 and/or the wiring harness 260 may be of a sufficient length to accommodate for the positional changes of the condenser fans 142, 144 between the operating position 152 and the service position 160 without disconnection of the plugs 256, 258. Indeed, in such embodiments, the plugs 256, 258 may be omitted, and the wire harnesses 246, 260 may be continuous with one another.

As set forth above, embodiments of the present disclosure may provide one or more technical effects useful for facilitating inspection, maintenance, and/or other operations on the condenser fans 142, 144 of the HVAC unit 100. In particular, the disclosed condenser fans assembly 102 is pivotable relative to the enclosure 104 to enable removal of the condenser fan 142, 144 from the enclosure 104 without involving time consuming disassembly the enclosure 104. Indeed, in the service position 160, the condenser fans 142, 144 may be exposed or removed from an interior of the enclosure 104 to provide ample access for maintenance, inspection, and/or replacement of the condenser fans 142, 144 and/or the condenser 112. Facilitating such maintenance operations on the condenser fans 142, 144 and/or condenser 112 in this manner may reduce a time period between non-operational periods of the HVAC unit 100, which may improve an overall efficiency of the HVAC unit 100 and/or reduce costs associated with HVAC system maintenance.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) unit, comprising:

a condenser fan assembly including a support frame having an opening and including a condenser fan coupled to the support frame and configured to force air through the opening, wherein the condenser fan assembly is configured to rotate at least 170 degrees about an axis of a hinge of the HVAC unit to translate between an operating position and a service position; and a brace configured to extend from an enclosure of the HVAC unit to the condenser fan assembly to hold the condenser fan assembly in the service position.

2. The HVAC unit of claim 1, wherein the condenser fan assembly is hingedly attached to the enclosure of the HVAC unit and is configured to pivot between the operating position and the service position.

3. The HVAC unit of claim 1, wherein the brace is configured to engage with a first mount of the enclosure and with a second mount of the condenser fan assembly to hold the condenser fan assembly in the service position.

4. The HVAC unit of claim 3, comprising the enclosure, wherein the first mount is a base rail of the enclosure, and the second mount is a bracket coupled to the support frame of the condenser fan assembly.

5. The HVAC unit of claim 1, wherein the condenser fan assembly is configured to force air across a condenser coil of the HVAC unit in the operating position.

6. The HVAC unit of claim 1, comprising a plurality of hinges coupling a lateral side of the support frame to the enclosure, wherein the plurality of hinges includes the hinge.

7. The HVAC unit of claim 6, wherein the lateral side is a first lateral side, the support frame includes a second lateral side opposite the first lateral side, and the second lateral side adjoins the enclosure in the operating position.

8. The HVAC unit of claim 7, wherein the second lateral side is distal to the enclosure in the service position.

9. The HVAC unit of claim 1, wherein the brace is actuatably attached to the enclosure and is configured to toollessly engage with a mount of the condenser fan assembly to hold the condenser fan assembly in the service position.

10. The HVAC unit of claim 1, wherein the brace is configured to toollessly engage with a first mount of the enclosure and toollessly engage with a second mount of the condenser fan assembly to hold the condenser fan assembly in the service position.

11. The HVAC unit of claim 1, wherein the brace is a first brace, and wherein the HVAC unit includes a second brace configured to extend from the enclosure to the condenser fan assembly to hold the condenser fan assembly in the service position.

12. A heating, ventilation, and/or air conditioning (HVAC) unit, comprising:

a condenser fan assembly including a support frame having a condenser fan coupled to the support frame;

a hinge configured to couple the condenser fan assembly to an enclosure of the HVAC unit, wherein the condenser fan assembly is configured to translate between an operating position and a service position; and a brace configured to extend from the enclosure to the condenser fan assembly to hold the condenser fan assembly in the service position, wherein the brace is configured to toollessly engage with a base rail of the enclosure and toollessly engage with a mount of the condenser fan assembly to hold the condenser fan assembly in the service position.

13. The HVAC unit of claim 12, wherein the support frame includes a first lateral side and a second lateral side opposite the first lateral side, wherein the hinge is coupled to the first lateral side, and the second lateral side is configured to abut the enclosure in the operating position.

14. The HVAC unit of claim 13, wherein the second lateral side is distal to the enclosure in the service position.

15. The HVAC unit of claim 13, wherein the support frame includes a pair of longitudinal sides extending between the first lateral side and the second lateral side, wherein the pair of longitudinal sides are configured to be secured to the enclosure via fasteners in the operating position.

16. The HVAC unit of claim 12, wherein the condenser fan is positioned within an interior of the enclosure and is configured to force an air flow across a condenser coil of the HVAC unit in the operating position, and wherein the condenser fan is external to the interior of the enclosure to expose the condenser fan and the interior of the enclosure in the service position.

17. A heating, ventilation, and/or air conditioning (HVAC) unit, comprising:

a condenser fan assembly including a support frame having an opening and including a condenser fan coupled to the support frame and configured to force air through the opening;

a plurality of hinges configured to attach the condenser fan assembly to an enclosure of the HVAC unit, wherein the condenser fan assembly is configured to translate between an operating position and a service position, wherein the condenser fan assembly is configured to rotate at least 170 degrees about an axis of a hinge of the plurality of hinges to transition from the operating position to the service position; and a brace configured to extend from the enclosure to the condenser fan assembly to hold the condenser fan assembly in the service position.

18. The HVAC unit of claim 17, wherein the plurality of hinges is configured to hingedly attach a first lateral side of the support frame to a lateral end portion of the enclosure, and wherein a second lateral side of the support frame, opposite the first lateral side, is configured to abut the enclosure in the operating position.

19. The HVAC unit of claim 18, wherein the second lateral side is distal to the enclosure in the service position, and wherein the brace is configured to extend from the enclosure to a mount of the condenser fan assembly to support the condenser fan assembly in the service position.

20. The HVAC unit of claim 17, wherein the brace includes a first mounting portion, a second mounting portion that extends generally parallel to the first mounting portion, and a central portion that extends between the first mounting portion and the second mounting portion and at an angle relative to the first mounting portion and the second mounting portion.

21. The HVAC unit of claim 20, wherein the first mounting portion is configured to engage with a base rail of the enclosure, and the second mounting portion is configured to engage with a mount of the condenser fan assembly in the service position of the condenser fan assembly.

22. The HVAC unit of claim 17, wherein the condenser fan assembly includes a wiring harness coupled to the support frame and configured to electrically couple the condenser fan to a controller of the HVAC unit.

23. The HVAC unit of claim 22, wherein the wiring harness terminates at a first plug configured to connect with a second plug of an additional wiring harness of the HVAC unit, wherein, in a disconnected configuration of the first and second plugs, the wiring harness is configured to pivot about the axis with the support frame between the operating position and the service position of the condenser fan assembly independently of the additional wiring harness.

24. The HVAC unit of claim 17, wherein the condenser fan assembly includes a mount coupled to a side wall of the support frame, wherein the brace is configured to toollessly engage with the mount in the service position of the condenser fan assembly.

25. The HVAC unit of claim 1, wherein the support frame is in a horizontal orientation, relative to a direction of gravity, in the operating position of the condenser fan assembly to enable the condenser fan to force the air through the opening in a vertical direction, relative to the direction gravity, in the operating position.

* * * * *